United States Patent [19]

Young et al.

[11] Patent Number: 4,852,478

[45] Date of Patent: Aug. 1, 1989

[54] APPARATUS FOR IMPRINTING A DOCUMENT WITH SECURE, MACHINE READABLE INFORMATION

[75] Inventors: James L. Young, Alexandria, Va.; James M. Patterson, Jr., Norwell, Mass.

[73] Assignee: Data Card Corporation, Minneapolis, Minn.

[21] Appl. No.: 30,627

[22] Filed: Mar. 24, 1987

[51] Int. Cl.[4] ..... B41F 19/02; B41M 1/24

[52] U.S. Cl. ..... 101/18; 101/269; 101/22

[58] Field of Search ..... 400/122, 138.2, 138.4, 400/138.6; 101/56, 20, 24, 26, 29, 110, 30, 18, 22, 269

[56] References Cited

U.S. PATENT DOCUMENTS

| | | | |
|---|---|---|---|
| 1,163,988 | 12/1915 | Epple | 101/30 X |
| 1,414,229 | 4/1922 | Steinkraus | 400/122 |
| 1,615,566 | 1/1927 | Brewer | 101/399 X |
| 3,166,008 | 1/1965 | Lewandoski | 101/269 |
| 3,260,199 | 7/1966 | Huntley et al. | 101/56 X |
| 3,279,369 | 10/1966 | Wight | 101/56 X |
| 3,780,669 | 12/1973 | Geiger et al. | 101/56 X |

FOREIGN PATENT DOCUMENTS

| | | | |
|---|---|---|---|
| 0029580 | 2/1986 | Japan | 101/110 |

*Primary Examiner*—Edgar S. Burr
*Assistant Examiner*—James Lisehora
*Attorney, Agent, or Firm*—Mason, Fenwick & Lawrence

[57] ABSTRACT

An imprinter for imprinting a document with two lines of information forming two rows of alphanumeric characters wherein the two rows of imprinted characters have corresponding characters and corresponding relative character positions such that each line contains the same informational content, one of the lines of rows being substantially tamperproof and the other being machine readable.

12 Claims, 2 Drawing Sheets

APPARATUS FOR IMPRINTING A DOCUMENT WITH SECURE, MACHINE READABLE INFORMATION

SUMMARY OF THE INVENTION

Thus, a primary object of this invention is to provide an improved imprinter capable of imprinting a document with information that is both substantially tamperproof and machine readable.

A further object of this invention is to provide an imprinter of the above type wherein two lines of information are imprinted on a document, the first line being substantially tamperproof and the second being machine readable, the informational content of both lines being the same.

Other objectives and advantages of this invention will become apparent upon reading the appended claims in conjunction with the following detailed description and attached drawing.

PRIOR ART

U.S. Pat. No. 1,615,566 granted to C. B. Brewer on Jan. 25, 1927 illustrates a method of printing whereby the printed information is punctured in a coded manner by special type to increase the tamperproof characteristics of the printed information. The instant invention is directed to more than mere puncturing of the paper as in Brewer—that is, the instant invention is directed to various embodiments of an imprinter for imprinting information which is both tamperproof and machine readable.

DETAILED DESCRIPTION OF THE DRAWING

DETAILED DESCRIPTION OF PREFERRED EMBODIMENTS OF THE INVENTION

Figure 1:
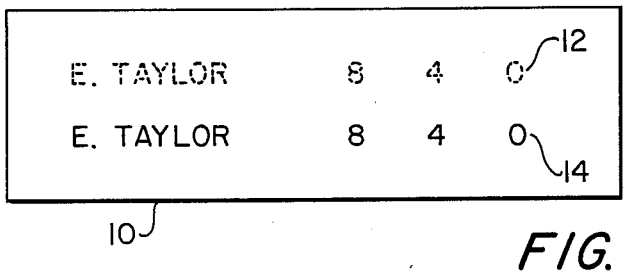
FIG. 1 is a plan view of a document imprinted with tamperproof and machine readable information in accordance with the invention.

Referring to FIG. 1 there is shown an invoice 10 imprinted in accordance with the apparatus of this invention. The lines of print are indicated at 12 and 14, the informational content of each line being the same. However, the respective functions of lines 12 and 14 are different. Thus, the line of print 12 is permanently deformed where the line of print or row of characters occurs on the document, this deformation of paper 10 taking place either by embossing of the paper or puncturing thereof by paper-embossing formations impressed against the document where line of print 12 occurs. Hence, the customer name and dollar amount of the transaction are rendered substantially tamperproof. That is, any attempt to erase or otherwise alter the name or dollar amount can be readily detected.

As can be appreciated in FIG. 1, although the line of print 12 is substantially tamperproof, it is not particularly readable and, in fact, it is not readable by conventional automatic reading machines. However, line 14 is of a substantially higher print quality than line 12 and, in particular, the print quality of line 14 is preferably such that it is easily read by automatic reading machines. Although line 14 is quite prone to being altered, the provision of a tamperproof line 12 effectively renders the information on imprinted invoice form 10 taken as a whole substantially tamperproof. Thus, by providing redundant lines of print 12 and 14, the complementary purposes of providing an invoice which is easily machine read while at the same time substantially tamperproof is provided.

Reference should now be made to the remaining figures which depict illustrative apparatus for effecting the imprinted invoice of FIG. 1.

Figure 2:
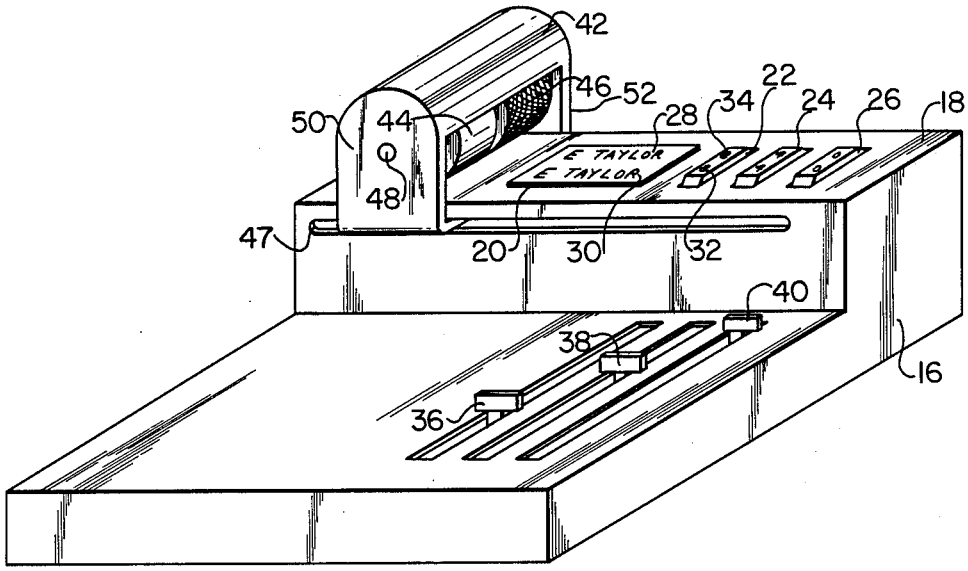
FIG. 2 is an isometric drawing of an imprinter depicting an illustrative embodiment of the invention.

Referring to FIG. 2 there is shown a variable amount imprinter having a base 16 including a print bed 18. Disposed on the print bed are printing members which take the form of printing plate 20 and print wheels 22–26. Indicated on plate 20 are two rows of characters 28 and 30, these respective rows of characters being raised from the surface of plate 20. As will be brought out in more detail hereinafter, the rows of characters 28 and 30 are respectively utilized to imprint the lines of print corresponding to the customer's name on the invoice 10 of FIG. 1. Also indicated at 32 and 34 are a pair of peripherally displaced characters on print wheel 22 which respectively correspond to the numeral "8" depicted in the transaction amount of the invoice 10 of FIG. 1. The print wheels 22–26 will also be described in more detail hereinafter.

Also shown in FIG. 2 are knobs 36–40 which respectively control the positioning of print wheels 22–26 with respect to the print bed 18. Also shown in a carriage assembly 42 which carries a first print roller member 44 and a second print roller member 46. The carriage assembly 42 is adapted to move over print bed 18 along grooves 47 in a well known manner to effect relative movement of print rollers 44 and 46 with respect to printing plate 20 and print wheels 22–26.

In the embodiment of FIG. 2, print roller 44 is associated with the row of characters 30 on printing plate 20 and character 32 on print wheel 22. A second print roller member 46 is associated with the row of characters 28 on plate 20 and character 34 on print wheel 22. As carriage assembly 42 is moved across the print bed the print rollers 44 and 46 coact with their associated rows of characters to effect imprinting therefrom.

In order to permanently deform the invoice 10 of FIG. 1 where it is imprinted at line 12, roller 46 is knurled at the pressure transmitting surface thereof by coining or swaging and thus, the coaction of this roller with line of print 28 of plate 20 and character 34 of print wheel 32 is such as to deform document 10 at line of print 12 thereby rendering this line substantially tamperproof. However, roller 44 is smooth at the pressure transmitting surface thereof and may be made of a conventional material such as Nylon.

Figure 3:
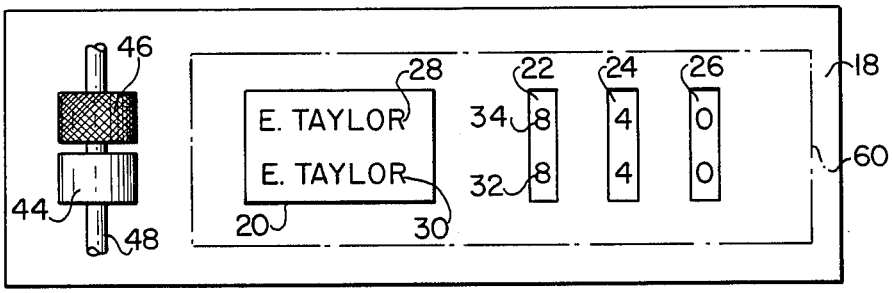
FIGS. 3 through 5 are cut-away plan views of the print bed of the imprinter of FIG. 2 illustrating various embodiments for mounting the print rollers of FIG. 2 within the carriage assembly.
Figure 4:
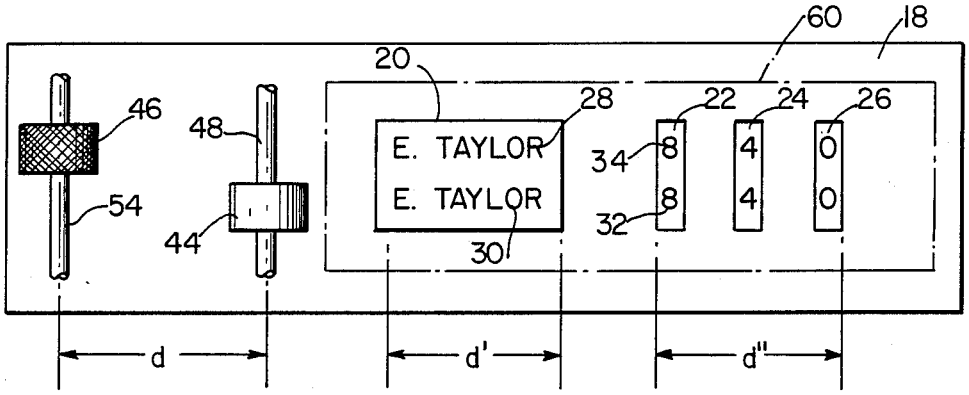
Figure 5:
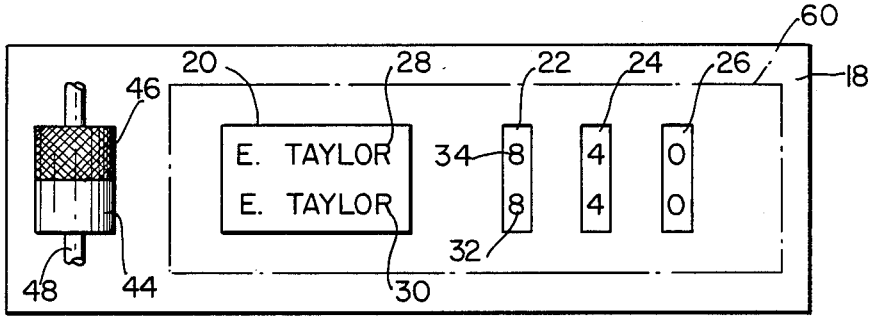

Various embodiments for mounting the rollers 44 and 46 within the carriage assembly 42 are illustrated in FIGS. 3–5. In these figures carriage 42 is not shown for purposes of clarity. The embodiment of FIG. 3 illustrates separate rollers 44 and 46 mounted on common shaft 48 which is connected to the opposite walls 50 and 52 of carriage 42, see FIG. 2 which illustrates the walls 50 and 52. The embodiment of FIG. 3 is the same as that of FIG. 2. In FIG. 3 the rows of characters 28 and 30 corresponding to the customer's name in lines 12 and 14 can more readily be seen. Further, the peripherally displaced characters 32 and 34 of print wheel 22 corresponding to the numeral "8" of the transaction amount in lines 12 and 14 of FIG. 1 can also be readily seen in FIG. 3. It also can be seen that the knurled roller 46 is associated with the tamperproof line of print 12 while the smooth print roller 44 is associated with the machine readable line of print 14.

The embodiment of FIG. 5 is substantially the same as that of FIG. 3 except that the rollers 44 and 46 are integrally connected to one another. They thereby constitute a common member which is mounted on shaft 48.

In the embodiment of FIG. 4 the print rollers 44 and 46 are respectively mounted on shafts 48 and 54. Thus, mountings of the print rollers within the carriage 50 are independent of one another. Hence, coaction of knurled roller 46 with its associated row of characters affects only slightly coaction of the roller 44 with its associated row of characters. Thus, any tendency on the part of roller 46 when coacting with its associated line of print to lessen the print quality obtained from roller 44 and its associated row of characters is substantially minimized. This undesirable effect can be further minimized by spacing the mounting of rollers 44 and 46 from one another by an amount which is greater than the length of a row of characters on either the printing plate 20 or on the print wheels 22–26. On FIG. 4 the distance between the print wheel mountings is indicated as d; the length of the row of characters on the printing plate 20 is indicated as d'; and the length of the characters on the print wheels 22–26 is indicated as d''. Hence, in accordance with the above formulation $d > d'$ or $d''$.

Preferred means for independently mounting the different rollers 44 and 46 within a carriage assembly are illustrated in U.S. Pat. No. 3,780,669.

Figure 6:
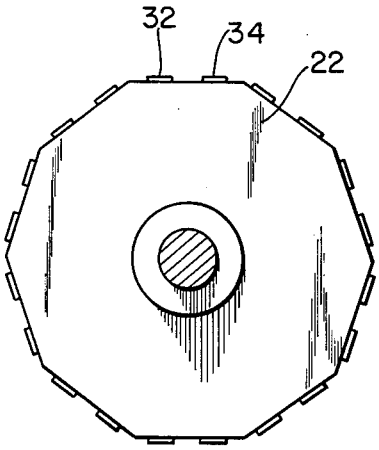
FIGS. 6 and 7 are respectively side and end views of an illustrative print wheel in accordance with the invention.
Figure 7:
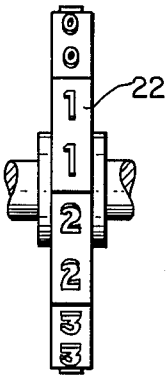

Reference should now be made to FIGS. 6 and 7 which illustrate print wheel 22. As can be seen in FIG. 6 ten sectors are disposed about the periphery of print wheel 22, each of the sectors including a pair of peripherally displaced characters which rise above the surface of the print wheel. Shown at the top of the print wheel of FIG. 6 are the characters 32 and 34 corresponding to the numeral "8" of FIG. 5 for example. In FIG. 7 is shown an end view of the print wheel where each of the peripherally displaced characters is also illustrated.

Figure 8:
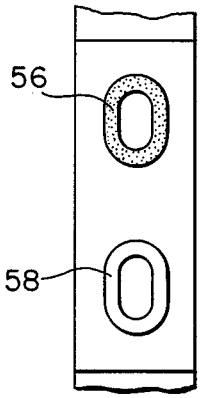
FIG. 8 is a plan view of an illustrative embodiment of a further modification of the invention.

In FIG. 8 is a further embodiment of the invention for effecting the tamperproof line of print 12 and the machine readable line of print 14 of the invoice 10 of FIG. 1. In particular, referring to FIG. 8, there is shown an upper character 56 which is knurled by swaging or coining or a similar type operation and a lower character 58, the upper surface of which is smooth. The characters 56 and 58 may correspond to the letter O shown in the customer's name of invoice 10 of FIG. 1 and/or they may correspond to the numeral 0 shown in the transaction amount of FIG. 1. Thus, the numerals 56 and 58 may correspond to the raised characters from the printing plate 20 or from the print wheels 22–26. When a combination such as that shown in FIG. 8 is utilized, the print rollers 46 and 48 are both smooth at the pressure transmitting surfaces thereof and thus, the deformation of the invoice 10 at the tamperproof line 12 thereof is effected by the knurling of the upper surface of the character 56. Of course, all characters in the row of characters corresponding to the tamperproof line would have their upper surfaces knurled as shown at 56 in FIG. 8 to effect the imprinting of an entire line of imprinted, tamperproof characters.

It should also be appreciated that when the knurled rollers embodiments of FIGS. 3–5 are utilized, the upper surface of all characters in each row of characters on the printing members 20 and 22–26 are substantially smoother than the pressure-transmitting surface of knurled roller 46. However, in some instances both the roller and the associated characters may be knurled.

Typically, knurled roller 46 is a knurled steel roller having diamond-shaped knurls. Of course, other types of materials and deformation patterns may be utilized.

The use of a knurled roller as in the embodiments of FIGS. 3–5 produces the sharpest imprint in that it perforates or deforms the invoice 10 most effectively and thus the line of print 10 is very effectively rendered substantially tamperproof. In some applications the knurled roller tends to lessen the expected life of printing plates 20. Thus, in these applications the knurled characters of the FIG. 8 embodiment are in some instances more preferable in that the line of print 12 is embossed with little or no document puncture. In this latter embodiment the use of indelible carbon document forms enhances the results obtained.

One particularly advantageous embodiment of the invention results when the knurled roller 46 of FIG. 4 is independently mounted with respect to print roller 44 as is done in the copending application referred to hereinbefore. The preloading of each roller tends to substantially minimize the tendency of the knurled roller to lessen the expected life of the printing member 20 or the print wheels 22–26.

Numerous modifications of the invention will become apparent to one of ordinary skill in the art upon reading the foregoing disclosure. During such a reading it will be evident that this invention provides unique apparatus for secure document imprinting for accomplishing the objects and advantages herein stated.

We claim:

1. An imprinter for imprinting a document with two rows of alphanumeric characters having the same character configurations and the same informational content wherein one of the rows is substantially tamperproof and the other is machine readable, comprising:

a base including a print bed;

a printing member including at least two rows of raised alphanumeric characters extending above said printing member;

a first print roller member;

a second print roller member;

a document adapted to be positioned over said printing member;

means for effecting relative movement of said first and second print roller members with respect to said printing member to thereby imprint on said document two rows of imprinted alphanumeric characters having corresponding characters and relative character positions in the respective rows;

at least one of said first and second print roller members and said printing member including paper-embossing formations producing protrusions in said document where one of said two rows of imprinted characters are imprinted thereon so that said one row of imprinted characters are rendered substantially tamperproof, said one row of imprinted characters being of poor print quality because of the deformation of said document; and means for making the print quality of the other of said two rows of imprinted characters imprinted on said document substantially better than that of said one row of imprinted characters.

2. An imprinter as in claim 1 where each of the characters of said one of said rows of characters on said printing member is knurled and the entire pressure transmitting surfaces of said first and second print roller members are substantially smoother than the surface of the characters of said one row.

3. An imprinter as in claim 2 where said printing member includes a plate removably disposed on the surface of said print bed, said plate having disposed on the surface thereof at least one pair of vertically displaced characters where one of said pair is included in said one row of characters and the other of said pair is included in said other row of characters.

4. An imprinter as in claim 2 where said printing member includes a print wheel having disposed around the periphery thereof a plurality of pairs of identical, peripherally displaced characters where one of said pair is included in said one row of characters and the other of said pair is included in said other row of characters, each pair of characters being disposed at a common plane on said periphery, said print wheel being disposed with an opening in said print bed so that no more than one pair of characters extends through said opening for a given angular position of said print wheel and means for positioning said print wheel with respect to said print bed to thereby select a desired pair of identical characters for positioning in said print bed.

5. An imprinter as in claim 2 where said first and second print roller members are mounted on a common shaft connected to said means for effecting relative movement of said first and second print roller members with respect to said printing member.

6. An imprinter as in claim 5 where said first and second print roller members are integrally connected to one another.

7. An imprinter as in claim 2 where said first print roller member is mounted independently of said second print roller member, both of said print roller members being mounted with respect to said means for effecting relative movement of said first and second print roller members with respect to said printing member.

8. An imprinter comprising:

a base including a print bed;

a printing member including at least two rows of raised characters extending above said printing member;

a first print roller member;

a second print roller member;

a document to be positioned over said printing member;

means for effecting relative movement of said first and second print roller members with respect to said printing member to thereby imprint on said document said two rows of characters;

at least one of said first and second print roller members and said printing member including means for deforming said document where one of said two rows of characters are imprinted thereon so that said one row of imprinted characters are rendered substantially tamperproof, said one row of imprinted characters being of poor print quality because of the deformation of said document; and means for making the print quality of the other of said two rows of characters imprinted on said document substantially better than that of said one row of imprinted characters, said second print roller member being knurled over at least a portion of the pressure transmitting surface thereof, said portion transmitting pressure to said one row of imprinted characters whenever relative motion is effected between said print roller members and said printing member.

9. An imprinter as in claim 8 where said second print roller member portion is a diamond knurled, steel roller.

10. An imprinter as in claim 8 where said first and second print roller members are mounted on a common shaft connected to said means for effecting relative movement of said first and second print roller members with respect to said printing member.

11. An imprinter as in claim 10 where said first and second print roller members are integrally connected to one another.

12. An imprinter as in claim 8 where said first print roller member, both of said print roller members being mounted with respect to said means for effecting relative movement of said first printing member.

* * * * *